US009804528B2

(12) United States Patent
Shinotsuka et al.

(10) Patent No.: US 9,804,528 B2
(45) Date of Patent: Oct. 31, 2017

(54) IMAGE FORMING APPARATUS THAT CLEANS DETECTION SURFACE OF SENSOR FOR DETECTING DEVELOPER ACCOMMODATED IN CONTAINING UNIT

(71) Applicant: CANON KABUSHIKI KAISHA, Tokyo (JP)

(72) Inventors: Masahiro Shinotsuka, Sashima-gun (JP); Tetsuhiro Yoshimoto, Tokyo (JP); Hirohisa Nakajima, Tsukubamirai (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/256,984

(22) Filed: Sep. 6, 2016

(65) Prior Publication Data

US 2017/0068205 A1 Mar. 9, 2017

(30) Foreign Application Priority Data

Sep. 8, 2015 (JP) ..... 2015-176941

(51) Int. Cl.
*G03G 15/08* (2006.01)

(52) U.S. Cl.
CPC ..... *G03G 15/0889* (2013.01); *G03G 15/0862* (2013.01); *G03G 2215/0897* (2013.01)

(58) Field of Classification Search
None
See application file for complete search history.

(56) References Cited

U.S. PATENT DOCUMENTS

| | | | | |
|---|---|---|---|---|
| 5,652,947 | A * | 7/1997 | Izumizaki | G03G 15/0879 399/258 |
| 8,238,796 | B2 | 8/2012 | Yoshida et al. | |
| 2006/0104670 | A1* | 5/2006 | Nishitani | G03G 15/0868 399/258 |
| 2012/0269524 | A1* | 10/2012 | Kakutani | G03G 15/0862 399/27 |
| 2017/0023877 | A1* | 1/2017 | Kotani | G03G 15/0831 |

* cited by examiner

*Primary Examiner* — Thomas Giampaolo, II
(74) *Attorney, Agent, or Firm* — Rossi, Kimms & McDowell LLP

(57) ABSTRACT

An image forming apparatus including a motor for rotating a stirring member and a cleaner to which a driving force of the motor is transmitted via a transmission mechanism. In a buffer container of a toner replenishment device of a developing device, a gear connected to a restriction member for stirring toner in the buffer container and restricting toner from dropping into a toner conveying section and a cleaning member for cleaning the detection surface of a toner sensor are driven by a motor. A CPU controls a timing at which a clutch stops transmission of the driving force from the motor to the gear, based on a result of detection by a flag sensor that detects an amount of rotation of the gear, and a rotational speed of the motor.

6 Claims, 10 Drawing Sheets

IMAGE FORMING APPARATUS THAT CLEANS DETECTION SURFACE OF SENSOR FOR DETECTING DEVELOPER ACCOMMODATED IN CONTAINING UNIT

BACKGROUND OF THE INVENTION

Field of the Invention

The present invention relates to an image forming apparatus that cleans a detection surface of a sensor for detecting a developer contained in a containing unit.

Description of the Related Art

An image forming apparatus of an electrophotographic type forms an electrostatic latent image on a photosensitive member, develops the electrostatic latent image using developer, and forms an image on a sheet. Since developer is consumed by forming the image, the image forming apparatus is provided with a developer replenishment device for replenishing developer to the image forming apparatus.

The developer replenishment device includes a container that contains developer, and an accumulation section that temporarily accumulates developer replenished from the accommodation container. In such a developer replenishment device, toner in the container is supplied to the image forming apparatus via the accumulation section.

An image forming apparatus disclosed in U.S. Pat. No. 8,238,796 includes a sensor for detecting that developer contained in a containing unit has become equal to or smaller than a predetermined amount, and a cleaner for cleaning a detection surface of the sensor from developer adhering thereto. To prevent developer adhering to the detection surface of the sensor from causing erroneous detection of the sensor, the cleaner slides on the detection surface.

However, in a case where the image forming apparatus uses a motor both for driving the elimination member and for driving a stirring member within a developing unit, although driving transmitted from the motor to the clear is stopped in predetermined timing, there is a possibility that the cleaner is not stopped at a predetermined position. This is because in a case where the rotational speed of the rotating member of the developing device is changed, an inertial force generated in the cleaner is also changed by a change in the rotational speed of the rotating member within the developing unit. For example, when the cleaner is not stopped at the predetermined position but is stopped in a state in contact with the detection surface of the sensor, there is a possibility that erroneous detection of the sensor is caused.

SUMMARY OF THE INVENTION

The present invention provides an image forming apparatus including a motor for rotating a stirring member and a cleaner to which a driving force of the motor is transmitted via a transmission mechanism, in which timing of transition to a state in which the transmission mechanism does not transmit the driving force is controlled such that the cleaner is prevented from being stopped at a predetermined position.

The invention provides a image forming apparatus comprising a containing unit configured to contain developer, an image forming unit including a developing unit to which the developer in the containing unit is supplied, and configured to form an image using the developer in the developing unit, a motor, a stirring member provided in the developing unit, and configured to be rotated by the motor to stir the developer in the developing unit, a first sensor provided in the developing unit and configured to detect the developer within the developing unit, a rotating member, a transmission mechanism configured to transmit a driving force of the motor to the rotating member, a cleaning unit including a cleaner for cleaning a detection surface of the first sensor, and configured to be controlled, in a state of the rotating member being rotated, to a first state in which the cleaner slides on the detection surface, and a second state in which the cleaner is separated from the detection surface, a second sensor configured to detect a rotational phase of the rotating member, and a controller configured to control a timing at which the transmission mechanism stops transmission of the driving force from the motor to the rotating member, based on a result of detection by the second sensor and a rotational speed of the motor.

Further features of the present invention will become apparent from the following description of exemplary embodiments (with reference to the attached drawings).

DESCRIPTION OF THE EMBODIMENTS

The present invention will now be described in detail below with reference to the accompanying drawings showing embodiments thereof.

Figure 1:
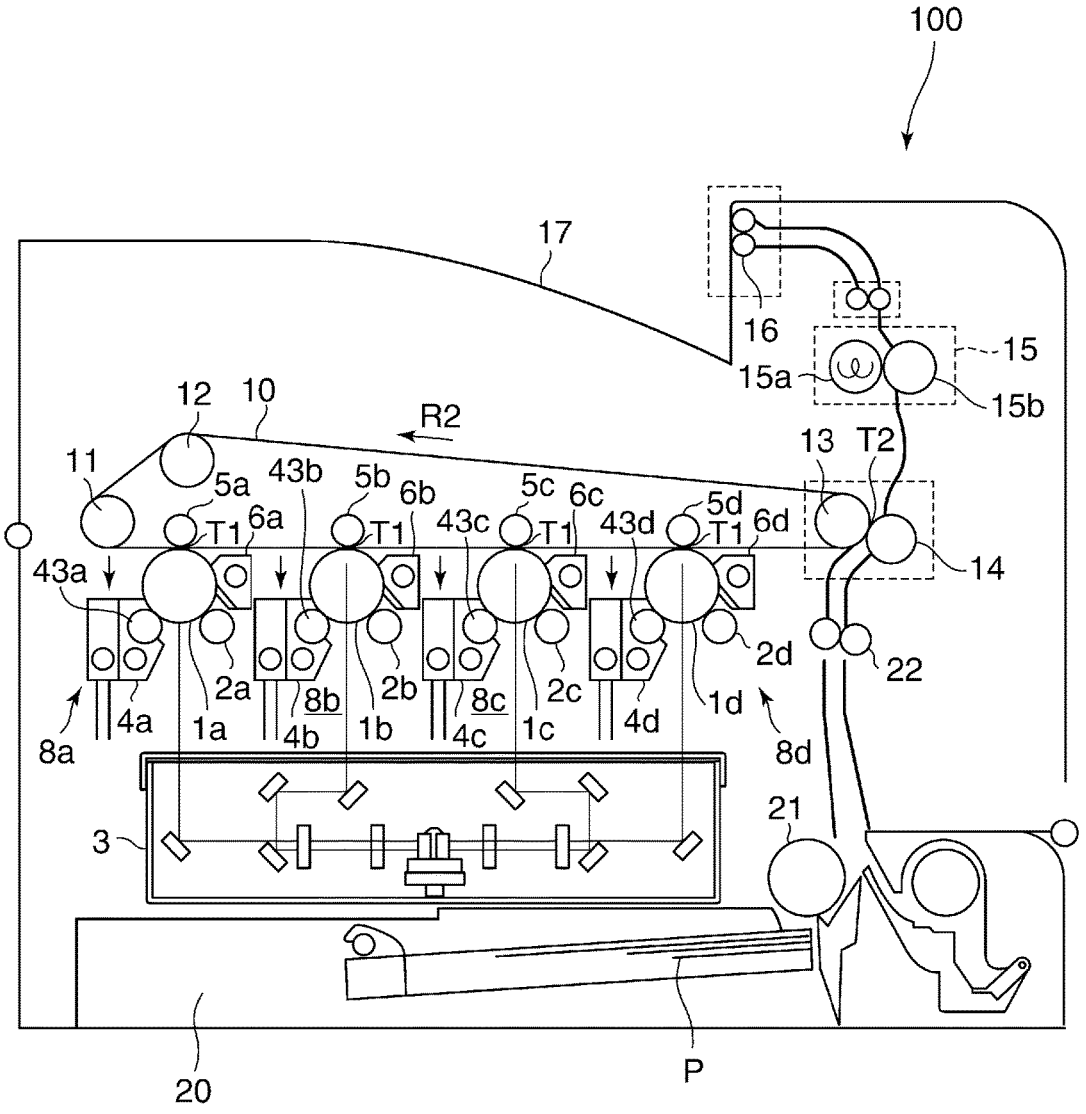
FIG. 1 is a schematic cross-sectional view of an image forming apparatus according to an embodiment of the invention.

FIG. 1 is a schematic cross-sectional view of an image forming apparatus according to an embodiment of the invention.

Referring to FIG. 1, the image forming apparatus 100 is a tandem intermediate transfer-type full color printer having a plurality of image forming stations arranged therein. The image forming apparatus 100 is comprised of an image forming section, a transfer section, a sheet accommodating section, and a conveying section for conveying sheets from the sheet accommodating section to the transfer section.

The image forming section includes the image forming stations 8*a*, 8*b*, 8*c*, and 8*d* arranged along the horizontal direction. The image forming station 8*a* forms a yellow toner image. The image forming station 8*b* forms a magenta toner image. The image forming station 8*c* forms a cyan toner image. The image forming station 8*d* forms a black toner image. The image forming stations 8*a*, 8*b*, 8*c*, and 8*d* have the same construction.

The image forming stations 8*a*, 8*b*, 8*c*, and 8*d* include photosensitive drums 1*a* to 1*d*, respectively. Arranged around the photosensitive drums 1*a* to 1*d* are electrostatic charging rollers 2*a* to 2*d*, exposure sections of an exposure device 3, developing devices 4*a* to 4*d*, primary transfer rollers 5*a* to 5*d*, and cleaning devices 6*a* to 6*d*, respectively.

The photosensitive drums 1*a* to 1*d* as photosensitive members are each formed e.g. by forming a photosensitive layer, negative in electrostatic charge polarity, on the outer peripheral surface of an aluminum cylinder, and rotate at a plurality of stages of processing speed switchable therebetween. An oscillating voltage formed by superimposing an AC voltage on a DC voltage is applied to the electrostatic charging rollers 2*a* to 2*d*, and the electrostatic charging rollers 2*a* to 2*d* each rotate along with rotation of an associated one of the photosensitive drums 1*a* to 1*d*, whereby the surface of each of the photosensitive drums 1*a* to 1*d* is uniformly charged to a negative potential.

The exposure sections of the exposure device 3 scan laser beams, which are on/off modulated based on scanning line image data obtained by developing respective decomposed color images of associated colors, using rotating polygon mirrors, not shown, respectively, to thereby form electrostatic latent images on the surfaces of associated ones of the photosensitive drums 1*a* to 1*d*, respectively. The developing devices 4*a* to 4*d* stir and charge two-component toners, for example, and cause the charged toners to be carried in a napping state on developing sleeves 43*a* to 43*d*, respectively. Then, the developing sleeves 43*a* to 43*d* each have an oscillating voltage formed by superimposing an AC voltage on a DC voltage, applied thereto, and are slid on the photosensitive drums 1*a* to 1*d*, respectively, whereby non-magnetic toners charged to negative polarity are transferred onto respective electrostatic latent images (exposure sections) on the photosensitive drums 1*a* to 1*d* whose potential has become positive relative to the developing sleeves 43*a* to 43*d*. With this, the electrostatic latent images on the photosensitive drums 1*a* to 1*d* are developed, respectively.

The primary transfer rollers 5*a* to 5*d* press an inner surface of an intermediate transfer belt 10, referred to hereinafter, thereby forming primary transfer sections T1 between the respective photosensitive drums 1*a* to 1*d* and the intermediate transfer belt 10. A DC voltage of positive polarity is applied to the primary transfer rollers 5*a* to 5*d*, whereby toner images of positive polarity carried by the photosensitive drums 1*a* to 1*d* are sequentially transferred onto the intermediate transfer belt 10 passing the primary transfer sections T1.

The intermediate transfer belt 10, which is rotated in a state brought into contact with the respective photosensitive drums 1*a* to 1*d* of the image forming stations 8*a* to 8*d*, is disposed above the image forming section. The toner images carried by the photosensitive drums 1*a* to 1*d* are superimposed on the intermediate transfer belt 10 to form a color image.

The intermediate transfer belt 10 as a transfer section extends around a tension roller 12, a drive roller 11, and a stretching roller 13, and is supported by the rollers 12, 11, and 13. The intermediate transfer belt 10 is driven for rotation by the drive roller 11 in a direction indicated by an arrow R2 in FIG. 1. A secondary transfer roller 14 is arranged in a manner opposed to the stretching roller 13. The secondary transfer roller 14 forms a secondary transfer section T2 by being brought into contact with the intermediate transfer belt 10 having an inner surface stretched by the stretching roller 13 connected to an earth potential. A DC voltage of positive polarity is applied to the secondary transfer roller 14, whereby the color image carried by the intermediate transfer belt 10 is transferred onto a sheet P, referred to hereinafter.

The sheet accommodating section is disposed on a bottom of the image forming apparatus 100. The sheet accommodating section includes a sheet cassette 20. The sheet cassette 20 contains sheets P.

Further, there is provided a conveying section which extends from the sheet accommodating section to a discharge tray 17 via the secondary transfer section T2, a fixing device 15, referred to hereinafter, and a discharge roller 16. The conveying section includes a separation roller 21, a registration roller 22, and the discharge roller 16, which are arranged along the conveying direction of a sheet P. The conveying section conveys the sheet P from the sheet cassette 20 to the discharge tray 17 via the secondary transfer section T2 and the fixing device 15.

Next, a detailed description will be given of the developing devices of the image forming apparatus 100 shown in FIG. 1.

Figure 2:
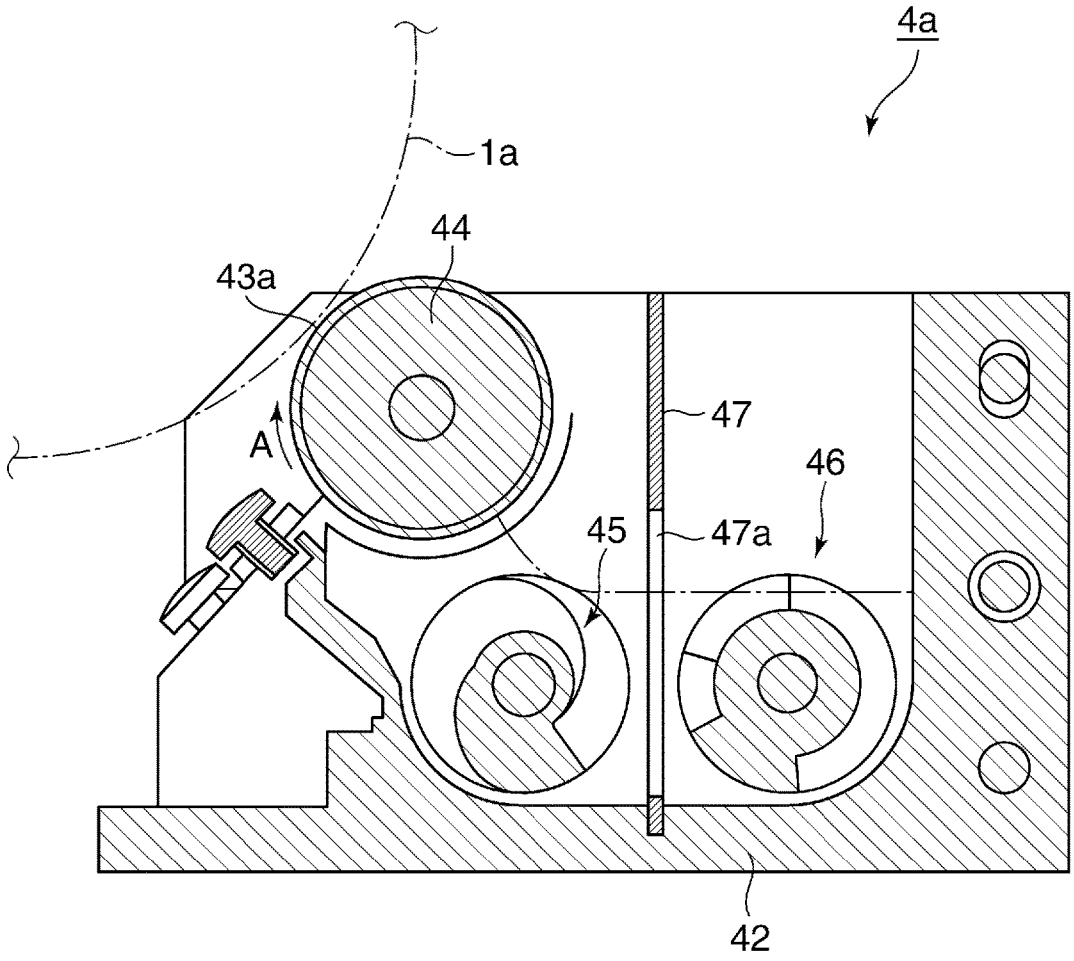
FIG. 2 is a cross-sectional view of a developing device of the image forming apparatus shown in FIG. 1.

FIG. 2 is a cross-sectional view of one of the developing devices of the image forming apparatus shown in FIG. 1. The developing devices of the image forming stations 8*a* to 8*d* have the same construction. Hereinafter, a description will be given of the construction of the developing devices using the developing device 4*a*.

In FIG. 2, the developing device 4*a* is shown in cross-section as viewed from the reverse side of the image forming apparatus 100 in FIG. 1.

The developing device 4*a* includes a developer container 42 as a toner containing unit. The developer container 42 is partitioned into two regions by a partition wall 47 including an opening 47*a* for passing e.g. a two-component toner as a developer. Conveying screws 45 and 46 as rotating members are arranged in the respective two regions adjacent to each other with the partition wall 47 interposed therebetween. The conveying screws 45 and 46 convey the two-component toner such that directions in which they convey the two-component toner become opposite to each other.

One of the two regions, which is opposed to the photosensitive drum 1*a*, is partially open, and the developing sleeve 43*a* as a toner carrier is provided such that part thereof is exposed from the opening of the region opposed to the photosensitive drum 1*a*. The developing sleeve 43*a* is formed of a non-magnetic material, and a magnet 44 having a plurality of fixed magnetic poles is fixed to the inside of the developing sleeve 43*a*. The developing sleeve 43*a* rotates in a direction indicated by an arrow A in FIG. 2.

The two-component toner includes a non-magnetic toner and a magnetic carrier. A mixture ratio between the non-magnetic toner and the magnetic carrier of the two-component toner in the developer container 42 as the toner containing unit is approximately 9:1 by weight, for example. The mixture ratio between the non-magnetic toner and the magnetic carrier is properly adjusted according to a toner charge amount, the particle diameter of the carrier, the configuration of the image forming apparatus 100, etc., and is not necessarily limited to 9:1.

In the developer container 42, the two-component toner is stirred and conveyed by rotation of the conveying screws 45 and 46, and is circulated within the developer container 42. During a developing operation, the developing sleeve 43*a* rotates in the direction indicated by the arrow A, and conveys the two-component toner to a developing area in which the developing sleeve 43*a* is brought into contact with the photosensitive drum 1*a*, while holding the two-component toner in a laminated state using the magnetic force of the magnet 44. The developing sleeve 43*a* supplies only the non-magnetic toner to the photosensitive drum 1*a* in the developing area. This causes the electrostatic latent image formed on the photosensitive drum 1*a* to be developed. After development of the electrostatic latent image, the two-component toner remaining on the developing sleeve 43*a* is collected within the developer container 42 according to rotation of the developing sleeve 43*a*. The developing devices 4*a* to 4*d* include toner replenishing devices for replenishing their developer containers 42 with toners of colors associated with the developing devices 4*a* to 4*d*, respectively.

Figure 3:
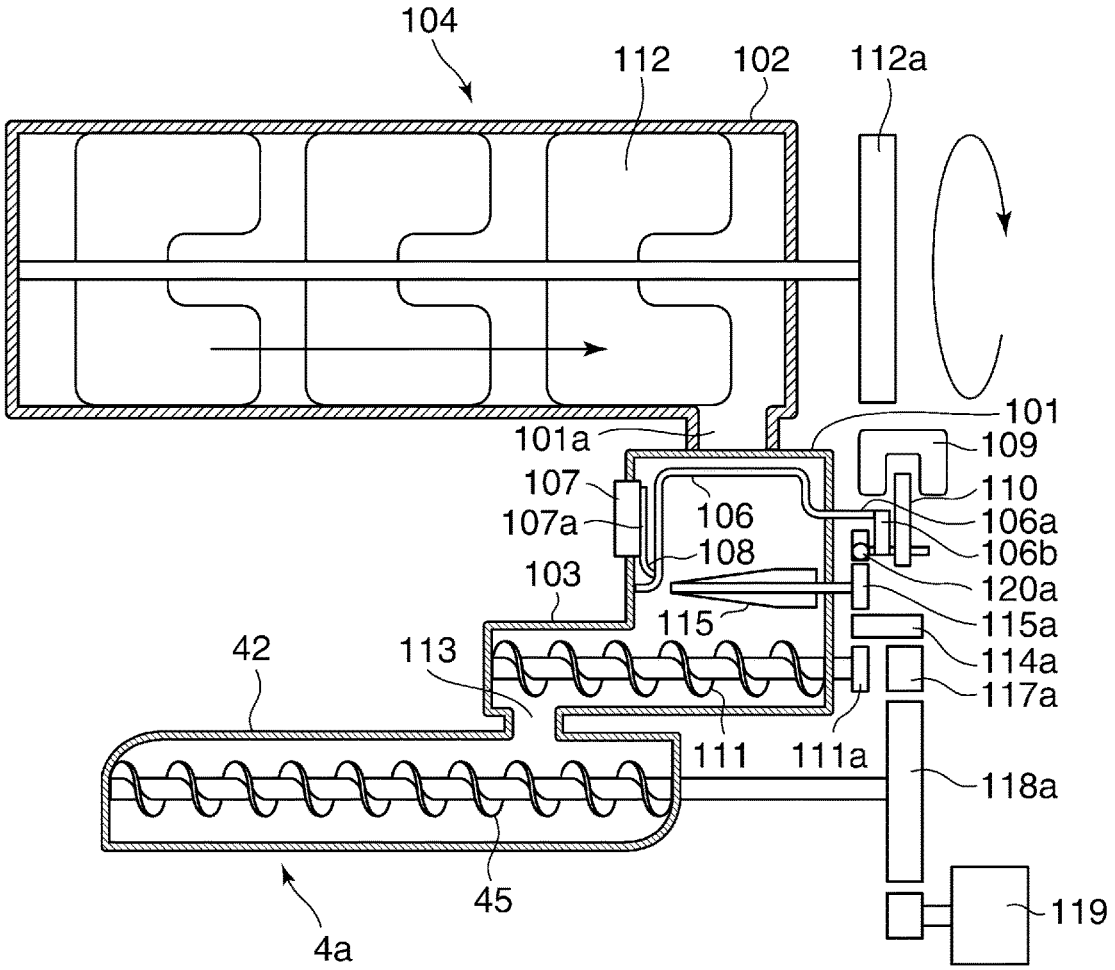
FIG. 3 is a schematic cross-sectional view of a toner replenishing device attached to the developing device shown in FIG. 2.

FIG. 3 is a schematic cross-sectional view of the toner replenishing device 104 attached to the developing device 4*a* shown in FIG. 2. Toner replenishing devices attached to the developing devices 4*b* to 4*d* also have the same construction as that of the toner replenishing device 104 attached to the developing device 4*a*.

Referring to FIG. 3, the toner replenishing device 104 as a developer replenishment device is mainly comprised of a toner container 102 and a buffer container 101 connected to the toner container 102 via a toner supply port 101*a*. The buffer container 101 functions as an accumulation section in which toner as a developer is accumulated. In a bottom of the buffer container 101, there is formed a toner conveying section 103. The toner conveying section 103 is connected to the developer container 42 of the developing device 4*a*, which is to be replenished with the toner, via a toner replenishing hole 113.

A conveying blade 112 is formed in the toner container 102. The conveying blade 112 is rotated by driving of a conveying blade driving member 112*a*. Toner in the toner container 102 is supplied to the buffer container 101 by rotating the conveying blade 112.

To stir the toner accumulated in the accumulation section, i.e. the buffer container 101, a stirring member 106 is provided in the buffer container 101. The stirring member 106 is rotatably supported on a rotating shaft 106*a* in the buffer container 101. One end of the rotating shaft 106*a* is extended to the outside of the buffer container 101, and outside the buffer container 101, is connected to a rotating shaft fixed to a gear 120*a* via a belt 106*b*. The stirring member 106 is rotated by driving of the gear 120*a*, and stirs the toner in the buffer container 101. A sensor flag 110 is not directly connected to the rotating shaft 106*a*, but is connected to a rotating shaft of the gear 120*a*.

The sensor flag 110 rotates in a manner interlocked with the stirring member 106, and a cleaning member 108 fixed to the stirring member 106. The cleaning member 108 rotates in a manner interlocked with the stirring member 106 in a predetermined direction, to thereby clean a detection surface 107*a* of a toner sensor, referred to hereinafter. Note that the phase of rotation of the cleaning member 108 at the time of stoppage thereof is set such that the cleaning member 108 is brought out of contact with the detection surface 107*a*. As a sensor 109, for example, a photo sensor is used.

A toner sensor 107 (first sensor) for electrically or optically detecting whether or not the toner remains in the buffer container 101 is formed on an upper side wall of the buffer container 101. The detection surface 107*a* of the toner sensor 107 is cleaned by the above-mentioned cleaning member 108.

The toner conveying section 103 provided in the bottom of the buffer container 101 has a side formed with a portion having a hollow cylindrical shape protruding in a substantially horizontal direction, and in this hollow cylindrical portion of the toner conveying section 103, a replenishing screw 111 is arranged as a developer replenishing member. The replenishing screw 111 is rotatable, and a gear 111*a* is connected to one end of the replenishing screw 111. The replenishing screw 111 has a spiral surface for conveying toner, and conveys toner from the buffer container 101 to the developer container 42 of the developing device 4*a*. The gear 111*a*, and the replenishing screw 111 are rotated by driving of an idle gear 114*a*.

The idle gear 114*a* is rotated in response to rotation of a gear 118*a* for causing rotation of the conveying screw 45 of the developer container 42, which is transmitted via a clutch 117*a* capable of transmitting a driving force. The gear 118*a* is rotated by driving of a motor 119 as a drive source. The clutch 117*a* is an electromagnetic clutch, and ON/OFF of transmission of the electromagnetic clutch is controlled by a CPU 501. In a case where the electromagnetic clutch is disengaged, even when the gear 118*a* is rotated, the idle gear 114*a* is not rotated.

The restriction member 115 for stirring toner in the buffer container 101 and restricting the toner from dropping into the toner conveying section 103 is formed at a portion of the buffer container 101, immediately above the toner conveying section 103. A gear 115*a* is connected to one end of the restriction member 115. The restriction member 115 is rotated in a manner interlocked with the stirring member 106, the cleaning member 108 interlocked with the stirring member 106, and the replenishing screw 111, by action of the gear 115*a*. More specifically, the gear 120*a*, the gear 115*a*, and the gear 111*a* are arranged such that the gears are in mesh with each other. Further, the gear 120*a*, the gear 115*a*, and the gear 111*a* are rotated in a manner interlocked with each other by rotation of the idle gear 114*a*. In short, while the idle gear 114*a* is being rotated, the clearing member 108 is driven for clearing the detection surface 107*a*.

The sensor 109 is provided in a manner opposed to the sensor flag 110, and detects the amount of driving the stirring member 106 and the position of the cleaning member 108 via the sensor flag 110, which is a detected member. Further, the sensor 109 detects rotation of the replenishing screw 111.

More specifically, the rotating shaft fixed to the gear 120*a* and the rotating shaft 106*a* of the stirring member 106 are connected by the belt 106*b*, and the rotational driving force of the gear 120*a* is transmitted to the rotating shaft 106*a*. Therefore, the sensor flag 110 is designed such that it is rotated through a predetermined angle when the idle gear 114*a* performs one rotation. Further, the restriction member 115 as well is driven for rotation in a manner interlocked with the stirring member 106 and the sensor flag 110.

For example, when the restriction member 115 as a driven portion performs a half rotation from the horizontal state, the sensor flag 110 performs a half rotation, and when the restriction member 115 performs one rotation, the sensor flag 110 performs one rotation. While the sensor flag 110 performs one rotation, the replenishing screw 111 driven by the idle gear 114*a* performs e.g. one rotation.

Further, the sensor 109 is designed such that it detects a rising edge of the sensor flag 110, i.e. a predetermined rotational phase of the restriction member 115, whenever the restriction member 115 performs a half rotation. Therefore, after the sensor 109 has detected the rising edge of the sensor flag 110 corresponding to the half rotation of the restriction member 115, the clutch 117*a* is turned off at the time of the lapse of a predetermined time period. This causes each of the restriction member 115 and the replenishing screw 111 to be rotated by inertia by a predetermined amount, and the restriction member 115 is caused to stop when it is in the horizontal state corresponding to one rotation after the half rotation thereof. At this time, the replenishing screw 111 stops after completing a predetermined number of rotations (one rotation in the case of the above example) for replenishing a required amount of toner.

In the image forming apparatus 100 including the toner replenishing devices 104 constructed as described above, toner images of the respective colors, which are formed on the photosensitive drums 1*a* to 1*d* in the image forming stations 8*a* to 8*d* of the image forming section, are sequentially transferred onto the intermediate transfer belt 10 (primary transfer) in superimposed relation to thereby form a color image. At this time, appropriate amounts of toners are replenished to the developing devices 4*a* to 4*d* from associated ones of the toner replenishing devices 104 as required based on results of detection by the toner sensors 107.

Referring again to FIG. 1, on the other hand, the separation roller 21 separates sheets P picked up from the sheet cassette 20, one by one, and delivers the separated sheet toward the registration roller 22. The registration roller 22 receives the sheet P when it is at rest, causes the sheet P to wait, and then delivers the sheet P to the secondary transfer section T2 in synchronism with the color image on the intermediate transfer belt 10.

In the secondary transfer section T2, the toner images of the color image formed on the intermediate transfer belt 10 are collectively transferred onto the sheet P conveyed to the secondary transfer section T2 (secondary transfer). In a case of a single-sided mode in which image formation is performed on one side of a sheet P, the sheet P onto which the color image has been secondarily transferred is conveyed to the downstream fixing device 15.

The fixing device 15 forms a heating nip by bringing a pressure roller 15*b* into pressure contact with a fixing roller 15*a* provided with a heater. As the sheet P is sandwiched and conveyed by the heating nip, the sheet P is heated and pressurized, whereby the toner images of the color image are melted and fixed on the surface of the sheet P. Then, the sheet P having the color image fixed thereon is discharged onto the discharge tray 17 by the discharge roller 16.

In a case of a double-sided mode in which images are formed on both sides of a sheet P, the sheet P having an image formed on one side thereof is inverted upside down after passing a double-sided path (not shown), and is then conveyed to the secondary transfer section T2 again. After that, reverse side recording is performed according to the same process of image forming as described above as to front side recording, whereby images are formed on the front and reverse sides of the sheet P. The sheet P having the images formed on the front and reverse sides thereof is discharged onto the discharge tray 17 by the discharge roller 16.

Next, a description will be given of the control configuration of the image forming apparatus 100.

Figure 4:
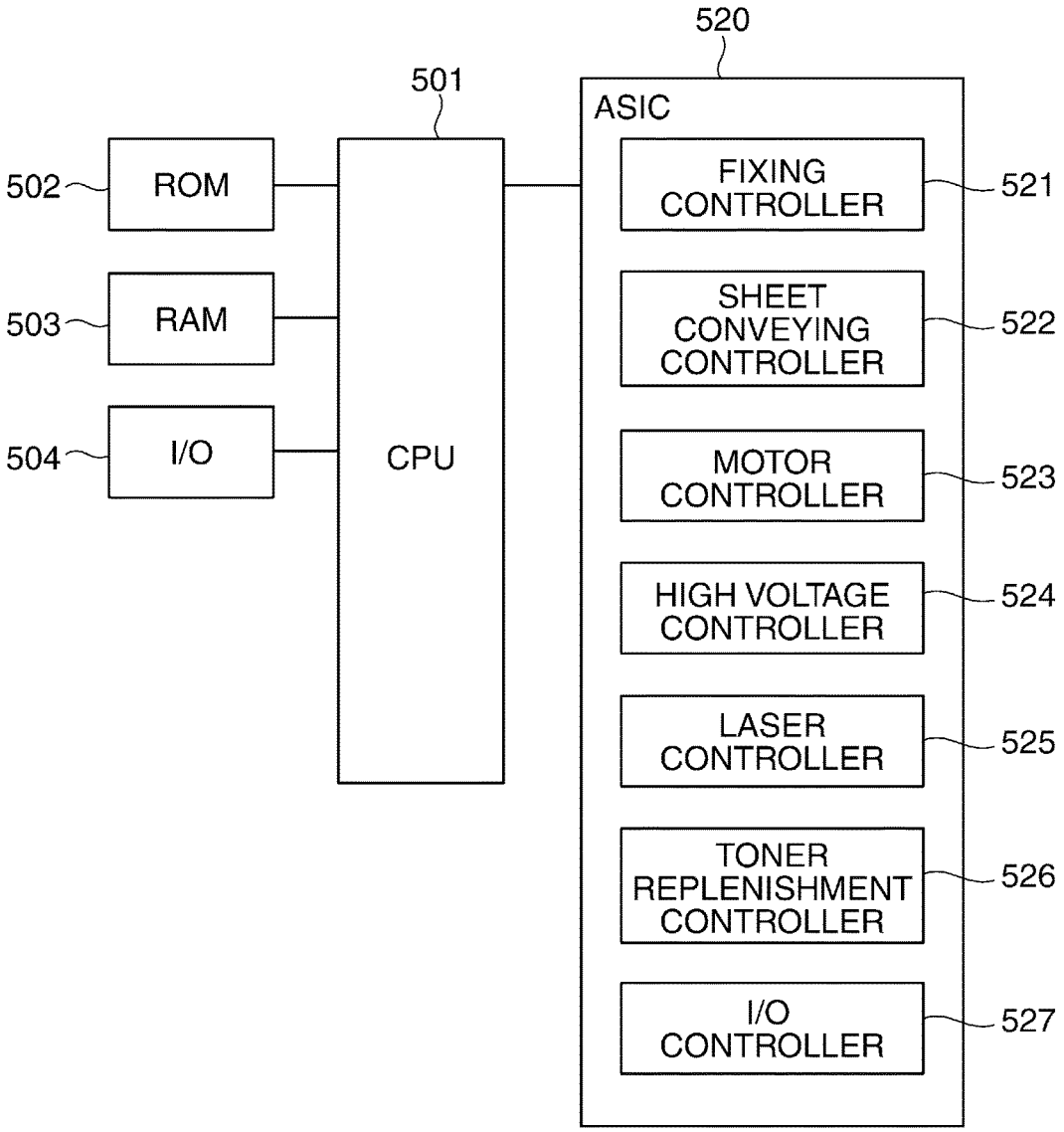
FIG. 4 is a control block diagram of the image forming apparatus.

FIG. 4 is a control block diagram of the image forming apparatus 100.

Referring to FIG. 4, the image forming apparatus 100 includes the CPU 501 for controlling the image forming section of the image forming apparatus 100. The CPU 501 is connected to a ROM 502 storing sequence programs and so forth, a RAM 503 storing settings and so forth required for the control, an I/O 504 for controlling input/output ports related to the control, and an ASIC (Application-Specific Integrated Circuit) 520 including controllers 521 to 527, referred to hereinafter.

The CPU 501 acquires image data and print setting information input from the I/O 504 as an acquisition unit, and determines a processing speed. Further, the CPU 501 determines, according to the processing speed, the rotational speed of the photosensitive drums, the rotational speed of the rotating mirrors, the conveying speed of the intermediate transfer belt 10, the conveying speed of the sheet P, the fixing temperature of the fixing device 15, and so forth. The I/O 504 receives image data transferred from an external PC or scanner. Print setting information accompanying the image data is input to the I/O 504. The print setting information is, for example, information on a sheet type of a sheet on which an image is to be formed, and a basis weight of the sheet.

The ASIC 520 includes a fixing controller 521 for performing heating control of the fixing device 15, and a sheet conveying controller 522 for controlling sensors and motors, not shown, for controlling conveyance of sheets. Further, the ASIC 520 includes a motor controller 523 for controlling the driving of the photosensitive drums 1*a* to 1*d* and the intermediate transfer belt 10, a high voltage controller 524 for controlling a high voltage during development, charging, transfer, and so forth, and a laser controller 525 for controlling the light amount of laser and the driving of polygon motors, not shown, for rotating the rotating polygon mirrors. The motor controller 523 functions as a controller of the present invention, and controls the rotational speed of the motor 119, referred to hereinafter, based on the processing speed determined by the CPU 501. Further, the ASIC 520 includes a toner replenishment controller 526 for replenishing toner according to the remaining amount of toner, and an I/O controller 527 for controlling the inputs and outputs of various sensors and the like.

Figure 5:
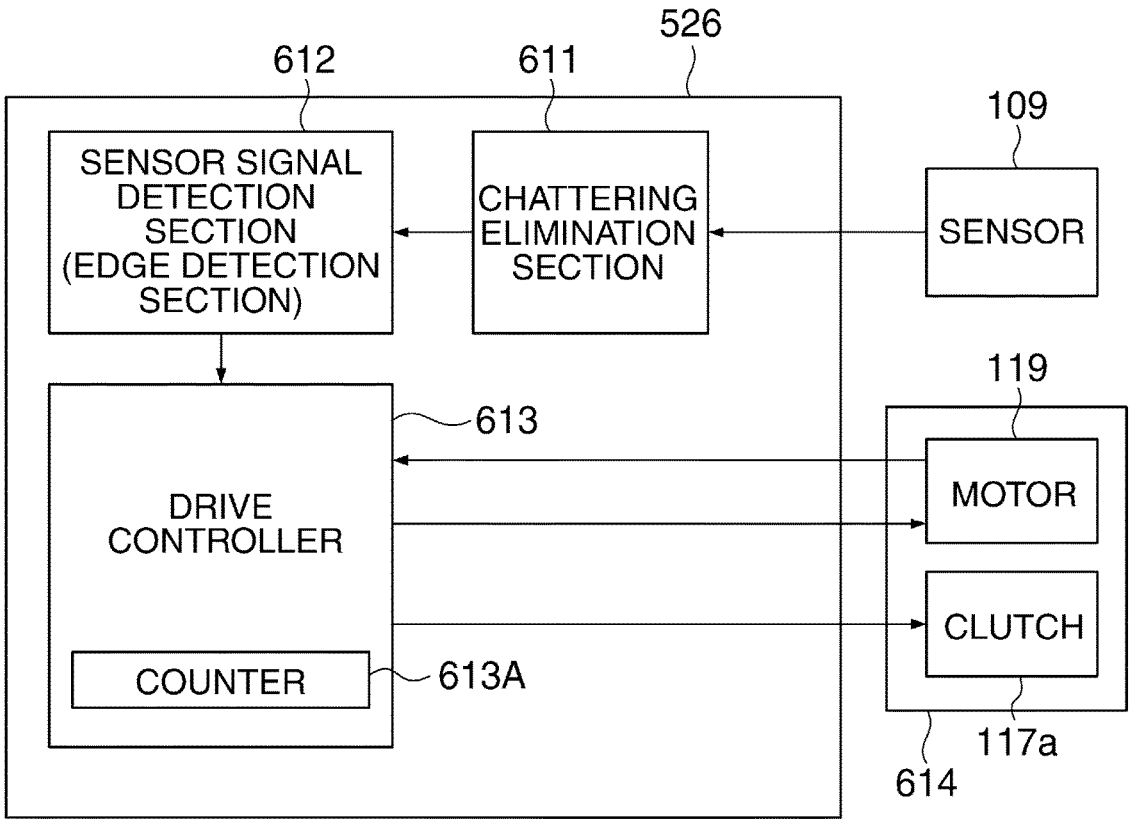
FIG. 5 is a control block diagram of a toner replenishment controller appearing in FIG. 4.

FIG. 5 is a control block diagram of the toner replenishment controller 526 appearing in FIG. 4. The toner replenishment controller 526 controls driving of the idle gear 114*a*.

Referring to FIG. 5, the toner replenishment controller 526 is comprised of a sensor signal detection section (edge detection section) 612, and a drive controller 613 including a counter 613A. The sensor signal detection section 612 is connected to the sensor 109 via a chattering elimination section 611. The drive controller 613 is connected to the motor 119 of a drive section 614, and the clutch 117*a*.

The sensor signal detection section 612 detects a rising edge that is generated in timing in which the sensor 109 is turned off by the sensor flag 110. The sensor signal detection section 612 receives a signal from the sensor 109 via the chattering elimination section 611 including a chattering elimination filter, not shown, and detects the rising edge based on the signal.

The drive controller 613 drives the motor 119 of the drive section 614, and the clutch 117*a*. The counter 613A counts a time period from detection of the rising edge by the sensor signal detection section 612 until turn-off of the clutch 117*a*.

Note that the counter 613A is a down counter in which a predetermined count is progressively made smaller, and is finally reduced to 0.

Hereinafter, a description will be given of an image forming process using the image forming apparatus 100 shown in FIG. 1.

Figure 6:
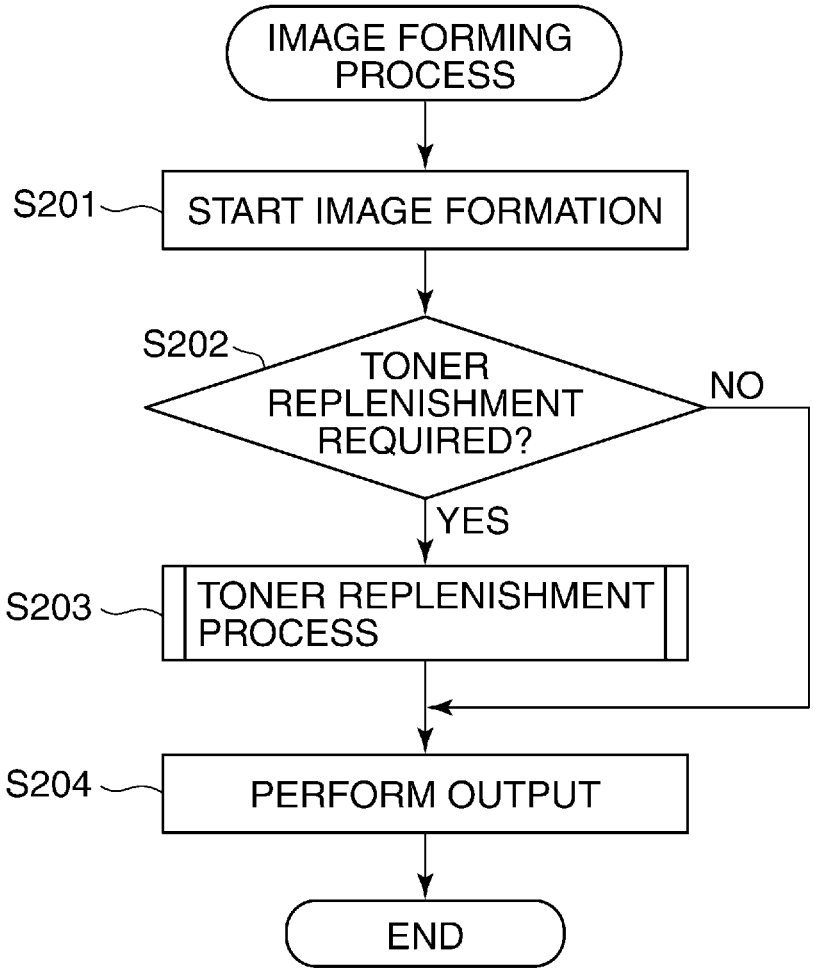
FIG. 6 is a flowchart of an image forming process using the image forming apparatus shown in FIG. 1.

FIG. 6 is a flowchart of the image forming process using the image forming apparatus shown in FIG. 1. The image forming process is executed by the CPU 501 of the image forming apparatus 100 according to an image forming process program stored in the ROM 502.

Referring to FIG. 6, the CPU 501 controls the controllers 521 to 525 of the ASIC 520 according to an image forming job set by a user, to thereby start an image forming operation (step S201). Then, the CPU 501 determines whether or not it is required to perform toner replenishment for any of the developing devices 4*a* to 4*d* (step S202). If it is determined in the step S202 that it is required to perform toner replenishment (YES to the step S202), the CPU 501 causes the toner replenishment controller 526 to perform a toner replenishment process, to thereby replenish a required amount of toner to the developing device that necessitating toner replenishment (step S203). Next, the CPU 501 continues the image forming process, and performs an output according to the image forming job (step S204), followed by terminating the present process.

On the other hand, if it is determined in the step S202 that it is not required to perform toner replenishment (NO to the step S202), the CPU 501 proceeds to the step S204 to perform the output according to the image forming job (step S204), followed by terminating the present process.

According to the process shown in FIG. 6, it is determined whether or not it is required to perform toner replenishment for a developing device, and if it is required to perform toner replenishment, the CPU 501 replenishes a required amount of toner to the developing device, and hence it is possible to perform an excellent image forming process using the developing device that has been replenished with the toner.

Next, a description will be given of the toner replenishment process performed in the step S203 in FIG. 6.

Figure 7:
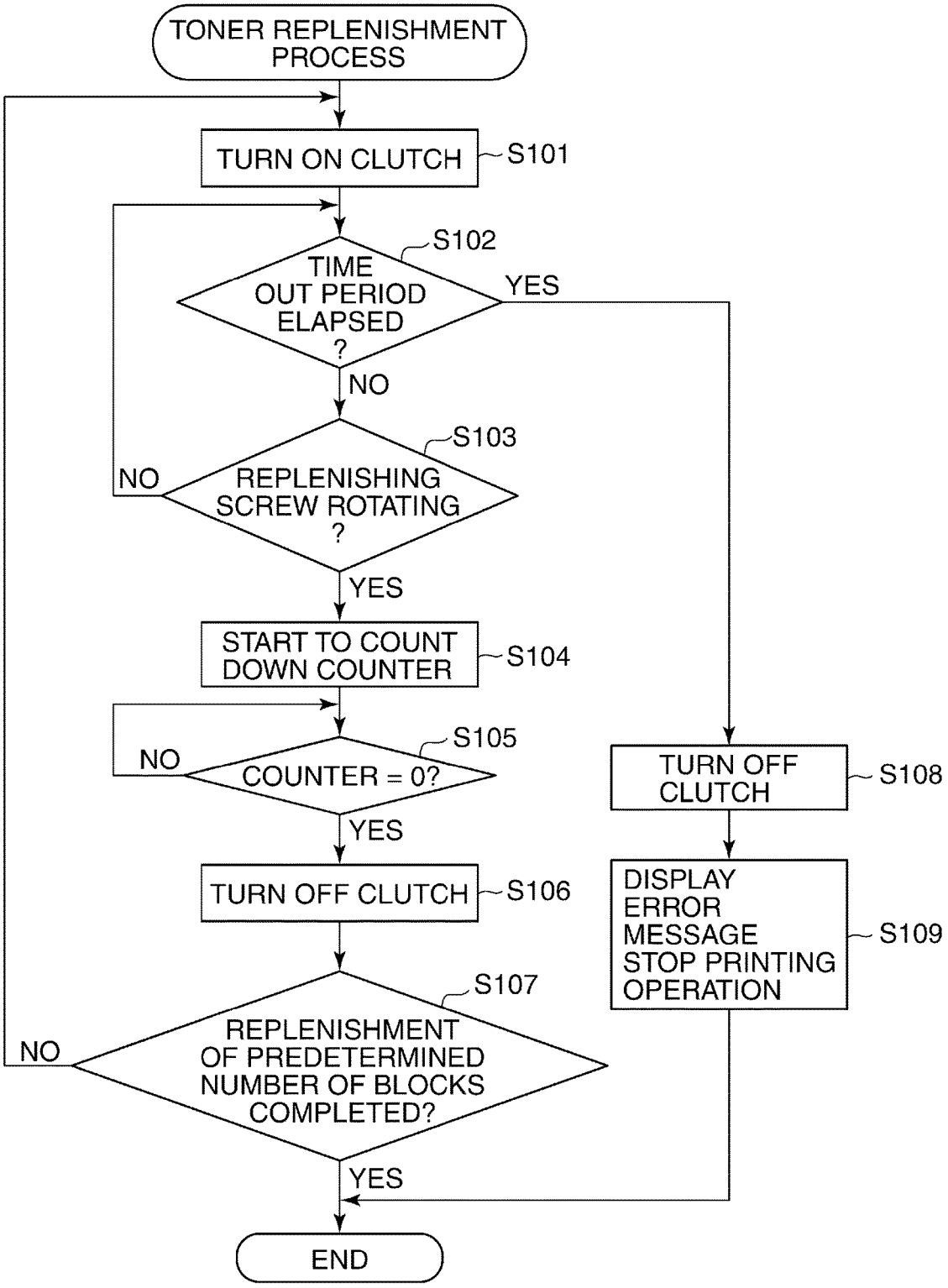
FIG. 7 is a flowchart of a toner replenishment process performed in a step in FIG. 6.

FIG. 7 is a flowchart of the toner replenishment process performed in the step S203 in FIG. 6. The toner replenishment process (toner supply control) is performed by the ASIC 520 of the image forming apparatus 100, through control of the toner replenishment controller 526 according to a toner replenishment process program stored in the ROM 502.

Referring to FIG. 7, before starting toner replenishment, first, the ASIC 520 calculates a toner replenishment amount as the amount of toner to be replenished to the developing device, based on a video count value (image data) or information from a toner density sensor of the developing device. Note that in this case, the toner replenishment amount may be calculated based on the density of a patch image or a toner density detected on the developing sleeve of the developing device.

Then, the ASIC 520 calculates the number (N) of blocks obtained by dividing the calculated toner replenishment amount (V) by a predetermined amount (V1). One block corresponding to the predetermined amount (V1) represents the amount of toner replenished to the developing device when the replenishing screw 111 performs one rotation.

The number (N) of blocks is calculated by the following equation (1):

$$\text{Number } (N) \text{ of blocks} = \text{toner replenishment amount } (V) \div \text{toner replenishment amount } (V1) \text{ per block}$$

Note that in this case, the toner replenishment amount per one block is not necessarily required to be limited to the toner replenishment amount per one rotation of the replenishing screw 111, but the amount of toner replenished to the developing device when the replenishing screw 111 performs a plurality of rotations may be set as the toner replenishment amount per one block.

After calculation of the number (N) of blocks corresponding to the toner replenishment amount, the ASIC 520 starts the toner replenishment process.

More specifically, the ASIC 520 causes the toner replenishment controller 526 to turn on the clutch 117*a* that connects the gear 118*a* and the idle gear 114*a* (step S101). With this, the idle gear 114*a* is driven to rotate the gear 111*a* and the replenishing screw 111, whereby toner replenishment to the developing device is started.

Then, the ASIC 520 determines whether or not a timeout period has elapsed (step S102). The timeout period is a time period taken for the replenishing screw 111 to perform at least one rotation, in other words, a time period taken for the toner replenishment amount (V1) at least per one block to be replenished to the developing device. If it is detected that the replenishing screw 111 has performed one rotation within the timeout period, a normal replenishing operation can be confirmed.

If it is determined in the step S102 that the timeout period has not elapsed (NO to the step S102), the ASIC 520 proceeds to a step S103. More specifically, the ASIC 520 determines based on a sensor signal from the sensor 109 whether or not the replenishing screw 111 is rotating (step S103), and repeatedly executes the steps S102 and S103 until it is confirmed that the replenishing screw 111 is rotating.

If it is detected in the step S103 that the replenishing screw 111 is rotating (YES to the step S103) before the timeout period has elapsed, the ASIC 520 starts to count down the count value of the counter 613A (step S104). In doing this, the ASIC 520 confirms the rotation of the replenishing screw 111 based on the detection of the rising edge by the sensor 109, which corresponds to the half rotation of the restriction member 115, and then starts to count down the count value of the counter 613A.

The counter value which is counted by the counter 613A is a predetermined value (time period) by which the timing of disengaging the clutch 117*a* shifted from the time of detection of a rising edge corresponding to a half rotation of the restriction member 115, i.e. the predetermined rotational phase of the restriction member 115, by the sensor 109, in order to cause the restriction member 115 to stop in the horizontal state after one rotation thereof.

In the present embodiment, the sensor flag 110 is configured so as to form a rising edge whenever the rotating restriction member 115 performs a half rotation. The rising edge is detected by the sensor 109.

Even when the clutch 117*a* is disengaged immediately at a time point when the rotating restriction member 115 has been placed in the horizontal state, the restriction member 115 and the replenishing screw 111 are rotated by inertia. Therefore, in this case, it is impossible to cause the restriction member 115 to stop in the horizontal state.

To solve this problem, in the present embodiment, it is assumed that the clutch 117*a* is disengaged after a predetermined timing, after the sensor 109 has detected a rising edge corresponding to a half rotation of the restriction member 115. The predetermined timing is determined based on a time period from when the clutch 117*a* is disengaged to when the restriction member 115 stops after being rotated by inertia.

As described above, the clutch 117*a* is disengaged by taking into account the time period from when the clutch 117*a* is disengaged to when the restriction member 115 stops, whereby it is possible to cause the restriction member 115 rotated by inertia to stop in the horizontal state after one rotation of the restriction member 115. At this time, the replenishing screw 111 stops after performing a number of rotations corresponding to a required toner replenishment amount, and hence a required number of blocks of toner is replenished to the developing device.

After the sensor 109 has detected the edge, a count value corresponding to the predetermined timing of disengaging the clutch 117*a* is changed according to the rotational speed of the restriction member 115, and hence according to the rotational speeds of the idle gear 114*a* and the gear 118*a*.

In the toner replenishing devices 104, the gear 118*a* is always driven during the image forming process in order to stir the toner in the developing device 4*a*. The idle gear 114*a* is connected to the gear 118*a* via the clutch 117*a*. Therefore, by turning on the clutch 117*a* in a developing state in which the gear 118*a* is rotating, the gear 118*a* and the idle gear 114*a* are connected to each other, whereby the idle gear 114*a* is rotated. On the other hand, by turning off the clutch 117*a* in the rotating state of the gear 118*a*, the connected state between the gear 118*a* and the idle gear 114*a* is released so that the two 118*a* and 114*a* are disconnected from each other. This makes it impossible to transmit the driving force of the gear 118*a* to the idle gear 114*a*, whereby only the gear 118*a* is rotated.

In the toner replenishing device 104, as described hereinabove, the gear 118*a* uses the motor 119 which is a motive power source, as a drive source. The motor 119 is set to one of a plurality of rotational speeds depending on an operation mode of the image forming apparatus. Therefore, the rotational speed of the idle gear 114*a* is changed between a plurality of rotational speeds according to the rotational speed of the motor 119. Further, the counter value set for the above-described counter 613A is also changed according to the rotational speed of the motor 119.

Here, a description will be given of a method of setting the counter value of the counter 613A.

Figure 8:
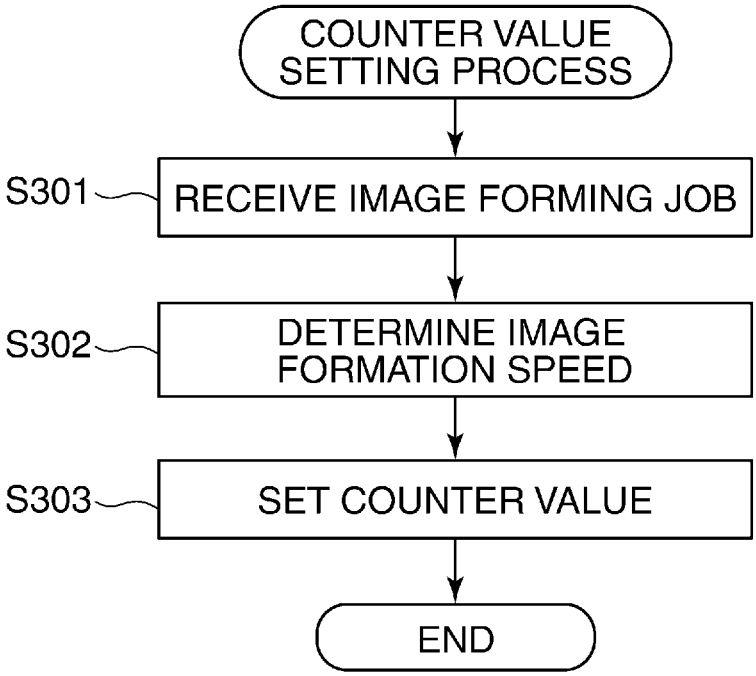
FIG. 8 is a flowchart of a counter value setting process performed by the image forming apparatus shown in FIG. 1.

FIG. 8 is a flowchart of a counter value setting process performed by the image forming apparatus shown in FIG. 1. The counter value setting process is performed by the ASIC 520 which controls the toner replenishment controller 526.

Referring to FIG. 8, first, the ASIC 520 receives an image forming job set by the user (step S301). Then, the ASIC 520 determines an image formation speed according to the job set by the user (step S302). The image formation speed is determined as appropriate according to a sheet type of sheets used to output an image, etc. The rotational speed of the motor 119 is determined by the image formation speed.

Next, the ASIC 520 sets a setting (count value) of the counter 613A according to the rotational speed of the motor 119 (step S303), and terminates the counter value setting process. The counter value of the counter 613A becomes smaller as the rotational speed of the motor 119 is high, but becomes larger as the rotational speed of the motor 119 is low. The counter value is empirically determined according to developing conditions including the rotational speed of the motor 119.

Referring again to FIG. 7, after starting to count down the counter 613A (step S104), the ASIC 520 determines whether or not the counter value of the counter 613A has become equal to 0, and waits for the counter value to become equal to 0 (step S105). After the counter value has become equal to 0, the ASIC 520 turns off the clutch 117*a* to stop the idle gear 114*a*, and stops the toner replenishing operation (step S106). This causes the cleaning member 108 to be moved by inertia and stop at a position retracted from the sensor detection surface 107*a*.

At this time, the restriction member 115 is rotated by inertia, such that it is placed in the horizontal state by a half rotation thereof, and thereafter stops in the horizontal state after one rotation thereof. With this, the toner is stopped from dropping, i.e. from being replenished to the developing device 4*a* thereafter. Further, at this time, the replenishing screw 111 continues rotation by inertia after disengagement of the clutch 117*a*, and stops when it has performed one rotation. As a consequence, one block of toner is replenished to the developing device.

In the following description, horizontal stop control of the restriction member 115 will be described with reference to FIGS. 9A and 9B.

Figure 9A:
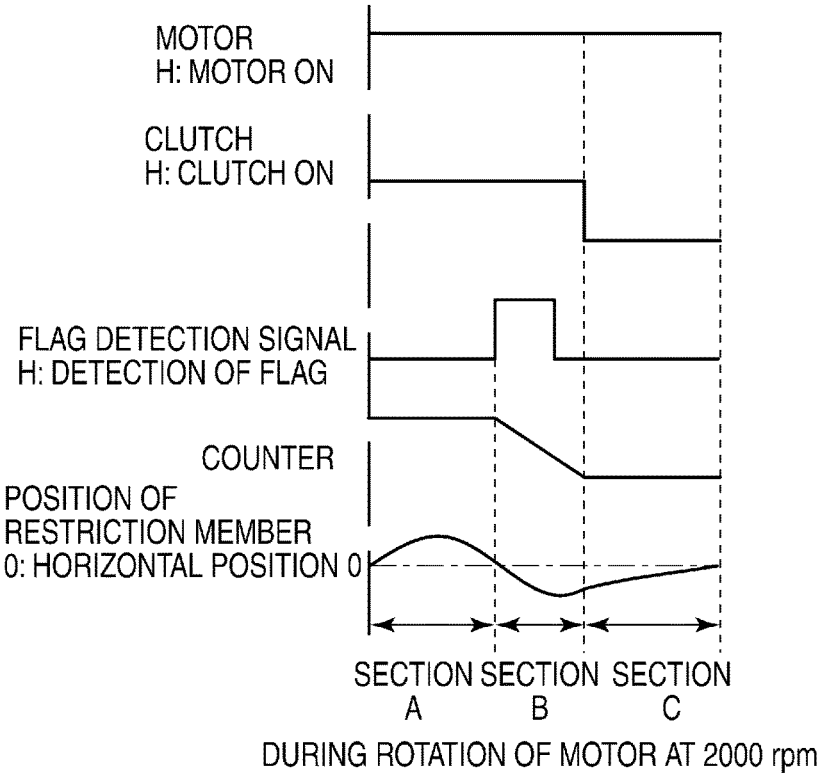
FIG. 9A is a timing diagram useful in explaining how a restriction member is stopped in a horizontal state when a rotational speed of a motor is 2000 rpm.
Figure 9B:
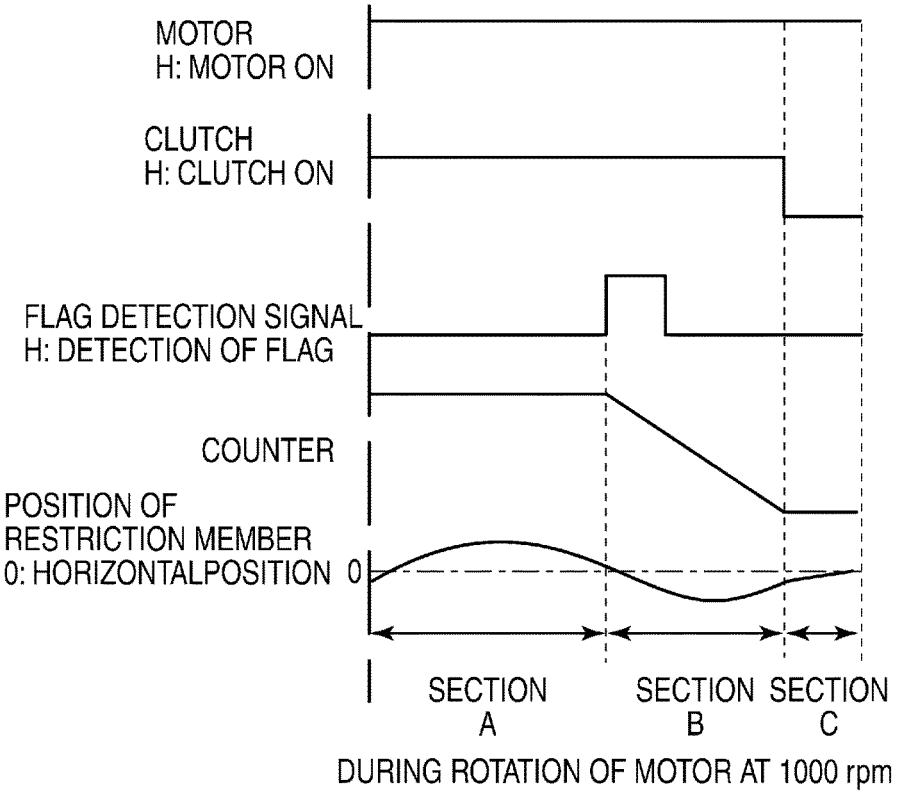
FIG. 9B is a timing diagram useful in explaining how the restriction member is caused to stop in the horizontal state when the rotational speed of the motor is 1000 rpm.

FIGS. 9A and 9B are timing diagrams useful in explaining how the restriction member 115 is caused to stop in the horizontal state. FIG. 9A is a timing diagram of a case where the rotational speed of the motor 119 is 2000 rpm, and FIG. 9B is a timing diagram of a case where the rotational speed of the motor 119 is 1000 rpm.

In FIG. 9A, a section A represents a state in which the clutch 117*a* is ON, and the restriction member 115 and the replenishing screw 111 are rotated to supply toner to an associated one of the developing devices. Within a range of the section A, the restriction member 115 is rotated according to the rotational speed of the idle gear 114*a*, with a point 0 indicating the horizontal state. When the replenishing screw 111 detects a rising edge corresponding to a half rotation of the restriction member 115 before the replenishing screw 111 performs one rotation, the horizontal stop control shifts to a section B. In the section B, a count value of the counter 613A, set in advance according to the rotational speed of the motor 119, starts to be counted down.

After the start of counting down, when a predetermined time period has elapsed, the clutch 117 is turned off, whereby the horizontal stop control shifts to a section C. Although the restriction member 115 has not performed one rotation when the clutch is turned off, the restriction member 115 is rotated by inertia until it is placed in the horizontal state after one rotation thereof, and stops while maintaining the horizontal state.

Figure 10A:
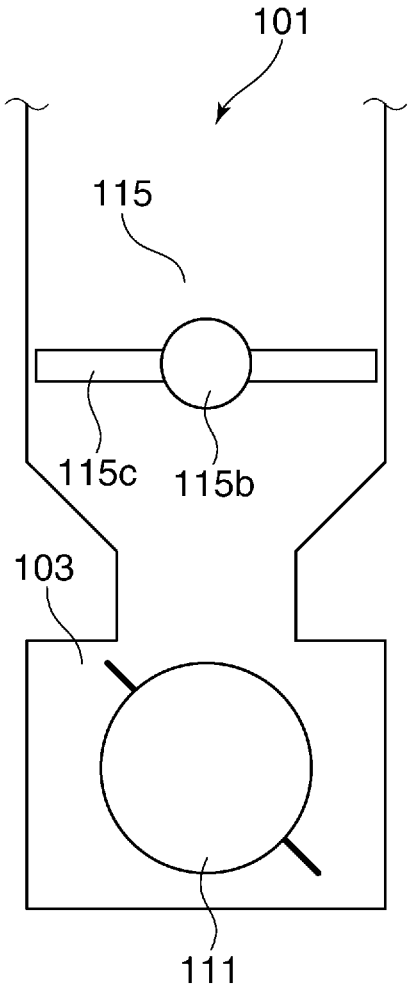
FIG. 10A is a cross-sectional view of the restriction member in a buffer container, which is in a horizontal position.
Figure 10B:
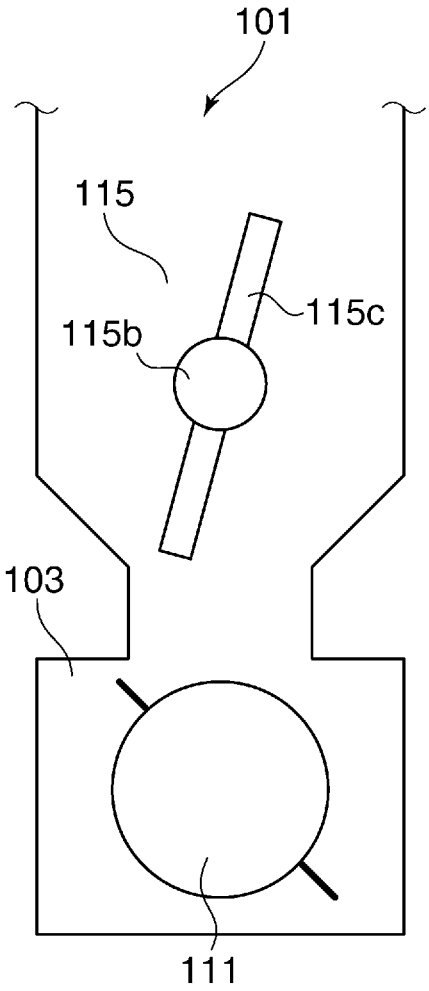
FIG. 10B is a cross-sectional view of the restriction member in the buffer container, which is not in the horizontal position.

FIGS. 10A and 10B are cross-sectional views of the restriction member 115 in the buffer container. FIG. 10A shows the restriction member 115 which is in a horizontal position, i.e. in the horizontal state, and FIG. 10B shows the restriction member 115 which is not in the horizontal position.

Referring to FIGS. 10A and 10B, the restriction member 115 includes a rotating shaft 115*b*, and a plate-shaped rotating section 115*c* that rotates about the rotational axis of the rotating shaft 115*b*. The rotating section 115*c* rotates about the rotational axis of the rotating shaft 115*b*, to thereby stir toner in the buffer container 101. Further, the rotating section 115*c* maintains the horizontal state during the stop of rotation, to thereby temporarily store toner in the buffer container 101.

More specifically, in FIG. 10A, the restriction member 115 is held in the horizontal state, and hence toner about to be dropped from the toner container 102 by its own weight is received by the restriction member 115 and is stored in the buffer container 101. Therefore, at this time, replenishment of the toner to a developing device, which is not intended by the user, is stopped.

On the other hand, in FIG. 10B, the restriction member 115 is displaced from the horizontal state, and hence it is impossible to receive toner about to be dropped from the toner container 102 by its own weight. Therefore, when the restriction member 115 stops in this state, toner which has dropped from the toner container 102 drops down to the toner conveying section 103 instead of being stored in the buffer container 101, and is conveyed to the developing device by the replenishing screw 111.

Referring again to FIGS. 9A and 9B, in the case of FIG. 9B where the motor 119 rotates at 1000 rpm, the restriction member 115 rotates more slowly in the sections A and B than in the case of FIG. 9A where the motor 119 rotates at 2000 rpm. This is because the rotational speed of the idle gear 114*a*, which is transmitted by the clutch 117*a*, is lower than in the case of the motor 119 rotating at 2000 rpm.

Further, in FIG. 9B, the section B represents a time required before the counting down of the count value of the counter 613A is terminated. The section B is set to be longer than in the case of FIG. 9A where the motor 119 rotates at 2000 rpm. This is because the rotational speed of the restriction member 115 is lower in the case of the motor 119 rotating at 1000 rpm, and hence to stop the restriction member 115 in the same position, it is required to cause the motor 119 to rotate longer than in the case of the motor 119 rotating at 2000 rpm.

On the other hand, the section C in FIG. 9B is set to be shorter than in the case of FIG. 9A where the motor 119 rotates at 2000 rpm. This is because the section C represents a time period over which the restriction member 115 is rotated by inertia, and in the case where the motor 119 rotates at 1000 rpm and the rotational speed of the motor 119 is lower, the time period over which the restriction member 115 is rotated by inertia becomes shorter than in the case of FIG. 9A where the motor 119 rotates at 2000 rpm.

In the present embodiment, the section B (time period corresponding to the counter value) is set to be shorter in a case where the rotational speed of the idle gear 114*a* is higher, and is set to be longer in a case where the rotational speed of the idle gear 114*a* is lower. Further, the section C is set to be longer in the case where the rotational speed of the idle gear 114*a* is higher, and is set to be shorter in the case where the rotational speed of the idle gear 114*a* is lower. Therefore, the count value of the counter 613A in the section B is properly set by estimating the length (time period) which varies with the rotational speed of the idle gear 114*a* and the amount of movement of the restriction member 115. This makes it possible to always stop the restriction member 115 after replenishing toner, in the horizontal state after one rotation thereof. Further, even when the amount of toner discharged from the toner container 102 is large, toner dropped from the toner container 102 can be temporarily stored in the buffer container 101, so that it is possible to prevent flashing (phenomenon in which a large amount of toner is discharged at the same time) caused by unintended replenishment.

Referring again to FIG. 7, after the clutch 117*a* is turned off (step S106), the ASIC 520 determines whether or not replenishment of a predetermined number of blocks of toner has been completed (step S107). If it is determined in the step S107 that the replenishment of the predetermined number of blocks of toner has been completed (YES to the step S107), the ASIC 520 terminates the present process.

On the other hand, if it is determined in the step S107 that the replenishment of the predetermined number of blocks of toner has not been completed (NO to the step S107), the ASIC 520 returns to the step S101. That is, the ASIC 520 repeatedly executes the steps S101 to S107 until the replenishment of the predetermined number of blocks of toner is completed.

Further, in a case where the sensor signal from the sensor 109 is not detected although the timeout period has elapsed, and it is impossible to detect that the replenishing screw 111 is rotating (YES to the step S102), the ASIC 520 proceeds to a step S108, wherein the ASIC 520 turns off the clutch 117*a* to stop the idle gear 114*a* to thereby stop the toner replenishing operation. Then, the ASIC 520 displays an error message, and stops the printing operation (step S109), followed by terminating the present process.

According to the toner replenishment process in FIG. 7, the clutch 117*a* is turned on to start the toner replenishment (step S101), and then it is confirmed that the replenishing screw 111 is rotating (step S103), whereafter the counting down of the counter 613A is started (step S104). After the counter 613A becomes equal to 0, if the replenishment of the predetermined number of blocks of toner has been completed, the clutch 117*a* is turned off. This makes it possible to positively replenish an amount of toner amount as the amount of developer corresponding to the predetermined number of blocks, to the developing device.

Further, according to the present embodiment, after the counter 613A becomes equal to 0, the clutch 117*a* is switched from an ON state to an OFF state (step S106). This makes it possible, after the clutch 117*a* has been turned off, to cause the restriction member 115 to be rotated by inertia until it is placed in the horizontal state after one rotation thereof, and stop. Therefore, toner dropped from the toner container 102 by its own weight can be received by the restriction member 115, whereby it is possible to stably supply a required amount of toner to an associated one of the developing devices while suppressing occurrence of flushing due to unintended replenishment of the toner.

Although in the present embodiment, the start and stop of operation of the idle gear 114*a* is controlled by turning on and off of the clutch 117*a* which uses the motor 119 as a drive source, the idle gear 114*a* can also be configured such that the operation thereof is directly started and stopped by the motor.

Further, although in the present embodiment, the rotating section 115*c* of the restriction member is formed by a plate-shaped member, the rotating section may have any shape insofar as it can receive toner dropped from the toner container 102. Further, although in the present embodiment, the developing device 4*a* is described as a developing device for a two-component magnetic brush development, a developing device having any other configuration, such as a developing device of a single-component contact developing type, may be used as the developing device.

In the present embodiment, by replacing the combination of the sensor flag 110 and the sensor 109 with a stepping motor, it is also possible to cause the cleaning member 108 to stop outside an area of the detection surface 107*a* of the toner sensor, every time, and cause the restriction member 115 to stop in the horizontal position. The stepping motor is capable of accurately starting or stopping the operation of the motor 119, which is the drive source of the idle gear 114*a*, without a time delay.

Further, although in the present embodiment, the sensor 109 is disposed in the body of the toner replenishing device 104, the toner sensor 107 may be disposed in a consumable, such as a process cartridge or a toner cartridge, and the sensor 109 may be disposed in the image forming apparatus body.

Note that in the present embodiment, by determining the timing of turning off the clutch 117*a* after the sensor 109 detects a rising edge of the sensor flag 110, it is also possible to always stop not only the restriction member 115 but also the stirring member 106 in the same positions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176941 filed Sep. 8, 2015 which is hereby incorporated by reference herein in its entirety.

What is claimed is:

1. An image forming apparatus comprising:

a containing unit configured to contain developer;

an image forming unit including a developing unit to which the developer in the containing unit is supplied, and configured to form an image using the developer in the developing unit;

a motor;

a stirring member provided in the developing unit, and configured to be rotated by the motor to stir the developer in the developing unit;

a first sensor provided in the developing unit and configured to detect the developer within the developing unit;

a rotating member configured to be moved to a restricting position where the rotating member is capable of restricting an amount of the developer to be supplied to the developing unit;

a transmission mechanism configured to transmit a driving force of the motor to the rotating member;

a cleaning unit including a cleaner for cleaning a detection surface of the first sensor, and configured to be controlled, in a case where the rotating member is being rotated, to be moved to a first position in which the cleaner slides on the detection surface, and to be moved a second position in which the cleaner is separated from the detection surface;

a second sensor configured to detect a rotational phase of the rotating member; and a controller configured to control a timing at which the transmission mechanism stops transmission of the driving force from the motor to the rotating member so that the rotating member is moved to the restricting position, based on a result of detection of the rotational phase of the rotating member by the second sensor and a rotational speed of the motor.

2. The image forming apparatus according to claim 1, wherein the second sensor detects a flag to output a signal; and wherein the controller controls the timing at which the transmission mechanism stops transmission of the driving force, after the second sensor outputs the signal, based on the rotational speed of the motor.

3. The image forming apparatus according to claim 1, further comprising an acquisition unit configured to acquire information about a sheet on which the image is to be formed by the image forming unit, and wherein the controller further controls the rotational speed of the motor, based on the information acquired by the acquisition unit.

4. The image forming apparatus according to claim 1, wherein the cleaning unit is controlled, in the case where the rotating member is being rotated, to be moved from the first position to the second position, and to be moved from the second position to the first position.

5. The image forming apparatus according to claim 1, wherein the controller controls the timing such that the cleaner does not stop on the detection surface.

6. The image forming apparatus according to claim 1, wherein the transmission mechanism includes a clutch.

* * * * *